US006134731A

United States Patent [19]

Thom et al.

[11] Patent Number: 6,134,731

[45] Date of Patent: Oct. 24, 2000

[54] ADJUSTABLE SUPPORT APPARATUS

[75] Inventors: Paul Thom, Montclair; Kurt Landsberger, Verona, both of N.J.

[73] Assignee: Bel-Art Products, Inc., Pequannock, N.J.

[21] Appl. No.: 09/283,935

[22] Filed: Apr. 1, 1999

[51] Int. Cl.[7] ..... A47C 31/00

[52] U.S. Cl. ..... 5/662; 5/424; 5/425; 5/426

[58] Field of Search ..... 5/662, 663, 659, 5/658, 424, 425, 426, 81.1; 211/119.006, 119.007, 86.07; 206/326

[56] References Cited

U.S. PATENT DOCUMENTS

| | | | |
|---|---|---|---|
| 3,029,447 | 4/1962 | Maertins . | |
| 3,739,793 | 6/1973 | Wilson . | |
| 4,432,522 | 2/1984 | Pruente et al. . | |
| 4,484,367 | 11/1984 | Jenkins | 5/426 |
| 4,504,992 | 3/1985 | Herron et al. . | |
| 5,257,426 | 11/1993 | Leoutsakos . | |
| 5,335,385 | 8/1994 | Brown . | |
| 5,384,927 | 1/1995 | Mardero et al. . | |
| 5,388,294 | 2/1995 | Reeder . | |
| 5,400,450 | 3/1995 | Leoutsakos . | |
| 5,435,028 | 7/1995 | Frala . | |
| 5,471,689 | 12/1995 | Shaw et al. . | |
| 5,581,829 | 12/1996 | Lee . | |
| 5,640,726 | 6/1997 | Fichner-Rathus | 5/426 |
| 5,651,152 | 7/1997 | Ritchie et al. | 5/663 X |
| 5,787,530 | 8/1998 | Brix . | |

*Primary Examiner*—Terry Lee Melius
*Assistant Examiner*—Fredrick Conley
*Attorney, Agent, or Firm*—Lawrence G. Fridman

[57] ABSTRACT

An adjustable support apparatus for facilitating movement of a person from one position to another includes one or more upright support units and an adjustable frame assembly for connecting or mounting the support unit(s) to a structure. Each support unit includes a compartment with a hollow interior and a handle connected to the compartment. A pocket with an opening is formed in the compartment for providing access to the hollow interior. The handle includes an elongate bar spaced from the compartment portion and sized to be grasped by the hand of a person. Two or more upright support units may be arranged in tandem and/or opposite each other. The distance between the support units is adjustable through the frame assembly.

24 Claims, 10 Drawing Sheets

FIG. 10
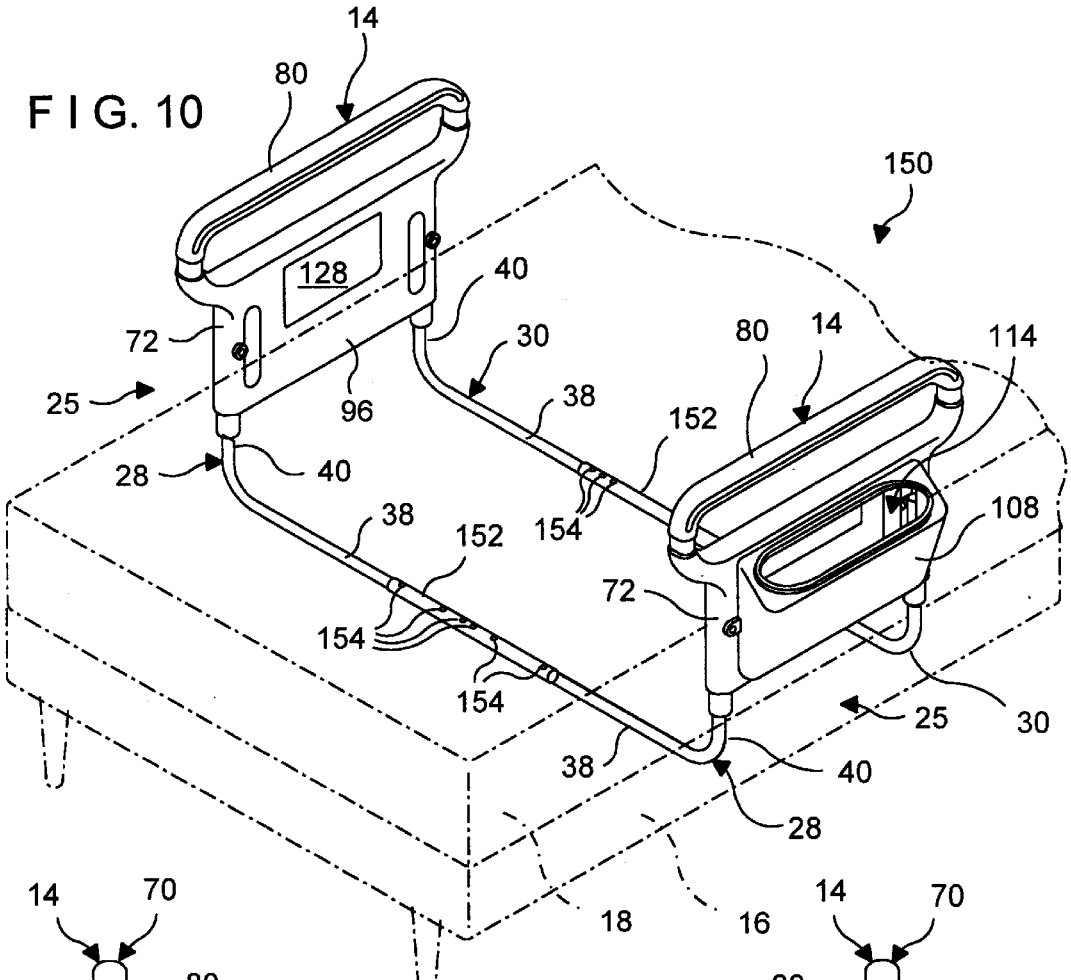
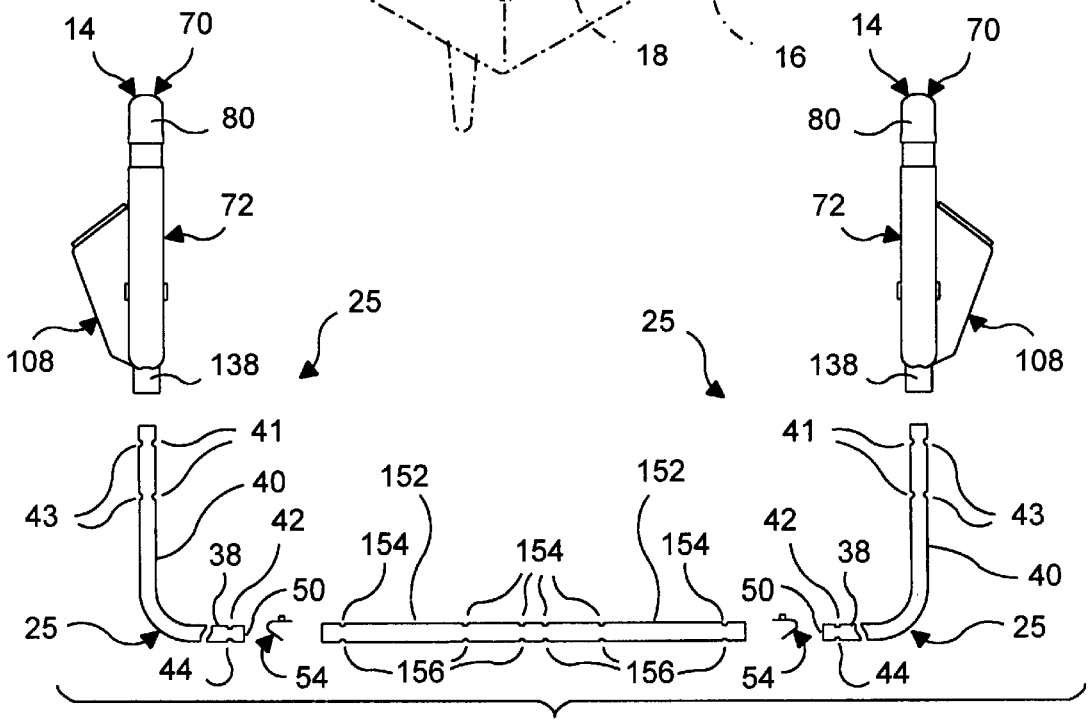
FIG. 11

ADJUSTABLE SUPPORT APPARATUS

BACKGROUND OF THE INVENTION

1. Field of the Invention

This invention relates generally to devices for assisting and supporting persons, and more particularly to rail-type support devices enabling a person to rise from and lower into a seated or lying position.

2. Description of the Related Art

Normally simple tasks such as rising from or lowering into a bed or chair and transferring between a bed and wheelchair can be extremely difficult for some elderly, handicapped, or other physically challenged persons. This task can be especially daunting when a caregiver or other person is not present to provide required assistance. Even when persons such as family members are present, they may not be physically capable of providing such necessary assistance. The loss of function, strength, or even pain in the lower body, hips, knees, ankles, legs, and so on, can significantly affect an individual's ability to perform such tasks.

In recognition of these problems, various devices have been proposed to assist an individual in rising from or lowering into a bed or chair or transferring between a bed and wheelchair. For example, U.S. Pat. No. 5,435,028 issued to Frala, and U.S. Pat. No. 3,739,793 issued to Wilson, disclose assistance devices with a base frame that rests on a floor and a rail assembly or handle that extends vertically upward from the base frame for grasping by a user. The assistance devices may be positioned adjacent a bed or chair with a portion of the support frame located under the bed or chair.

U.S. Pat. No. 5,471,689 issued to Shaw et al., and U.S. Pat. No. 5,787,530 issued to Brix disclose assistance devices with a base that is located between a box spring and mattress of a bed and a handle that extends vertically upward from the base for grasping by a person.

Some prior art assistance devices are generally unwieldy and/or difficult to install, while other prior art assistance devices provide inadequate support for a user. Furthermore, none of the above discussed assistance devices are formed with compartments or pockets which are used to conveniently store necessary items such as medication, books and documents at the bedside. Nevertheless, it is often important or critical to an infirm or disabled person to reach such necessary items while lying or sitting on a bed. Furthermore, a combination of an assistance device with a storage pocket or compartment often provides significant space saving which is important in the limited environment of living quarters or hospitals.

SUMMARY OF THE INVENTION

It is therefore an object of the present invention to provide an assistance device that is relatively easy to assemble and install.

It is a further object of the present invention to provide an assistance device that can be securely attached to a structure and therefore provide adequate support for a user during use and is formed with a pocket for conveniently storing items at the bedside.

It is an even further object of the present invention to provide an assistance device that can be installed between the box springs and mattress of a bed, and can be adjusted to accommodate different bed sizes.

According to the invention, a support apparatus for facilitating movement of a person from one position to another includes a compartment portion having a front wall connected to a rear wall by opposing side walls and upper and lower walls to thereby form a hollow interior. A handle portion is connected to the compartment portion and includes an elongate bar spaced from the compartment portion and sized to be grasped by the hand of a person.

In one preferred embodiment, a pocket is formed in the compartment portion and extends outwardly from one of the compartment walls. An opening is formed in the pocket for permitting access to the hollow interior through the pocket. The hollow interior of the compartment may be used for storing medication, books, magazines, and the like.

A frame assembly having a pair of spaced frame members is preferably connected to the compartment portion and extends downwardly therefrom for mounting the support apparatus to a structure. The frame members are preferably L-shaped and include a first leg telescopically received in the compartment portion and a second leg extending substantially perpendicular from the first leg. A U-shaped extension having a pair of spaced extension legs extending from opposite ends of a cross member is preferably in telescopic engagement with one of the second legs to thereby adjust the distance between the cross member and the compartment portion. A strap may be connected to the U-shaped extension for securing the support apparatus to a structure.

According to a further embodiment of the invention, an adjustable support apparatus for facilitating movement of a person from one position to another includes a compartment portion having a front wall connected to a rear wall by opposing side walls and upper and lower walls to thereby form a hollow interior. A handle portion is connected to the compartment portion and includes an elongate bar spaced from the compartment portion. The bar is sized to be grasped by the hand of a person. A frame assembly having a pair of spaced frame members is connected to the compartment portion and extends downwardly therefrom for mounting the support apparatus to a structure.

According to an even further embodiment of the invention, an adjustable support apparatus for facilitating movement of a person from one position to another comprises at least two upright support units arranged substantially parallel to each other. Each unit includes a compartment portion having a front wall connected to a rear wall by opposing side walls and an upper and lower wall to thereby form a hollow interior, and a handle portion connected to the compartment portion. The handle portion includes an elongate bar spaced from the compartment portion. The elongate bar is sized to be grasped by the hand of a person. A frame assembly includes a pair of spaced upright frame members connected to each compartment portion and extends downwardly therefrom. At least one transverse frame member is connected to the pairs of spaced upright frame members to thereby connect the at least two upright support units together. The two upright units may be arranged in tandem and/or opposite each other.

There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention. It is important, therefore, that the claims be regarded as including such equivalent constructions since they do not depart from the spirit and scope of the present invention. The foregoing and other features and advantages of the invention will be apparent from the following more particular description of preferred embodiments of the invention, as illustrated in the accompanying drawings.

BRIEF DESCRIPTION OF THE DRAWINGS

The preferred embodiments of the present invention will hereinafter be described in conjunction with the appended drawings, where like designations denote like elements, and:

FIG. 10 is an orthographic view of an adjustable support apparatus according to a second embodiment of the invention for mounting to a bed;

FIG. 11 is an exploded side elevational view of the adjustable support apparatus of FIG. 10;

DETAILED DESCRIPTION OF THE PREFERRED EMBODIMENTS

Figure 1:
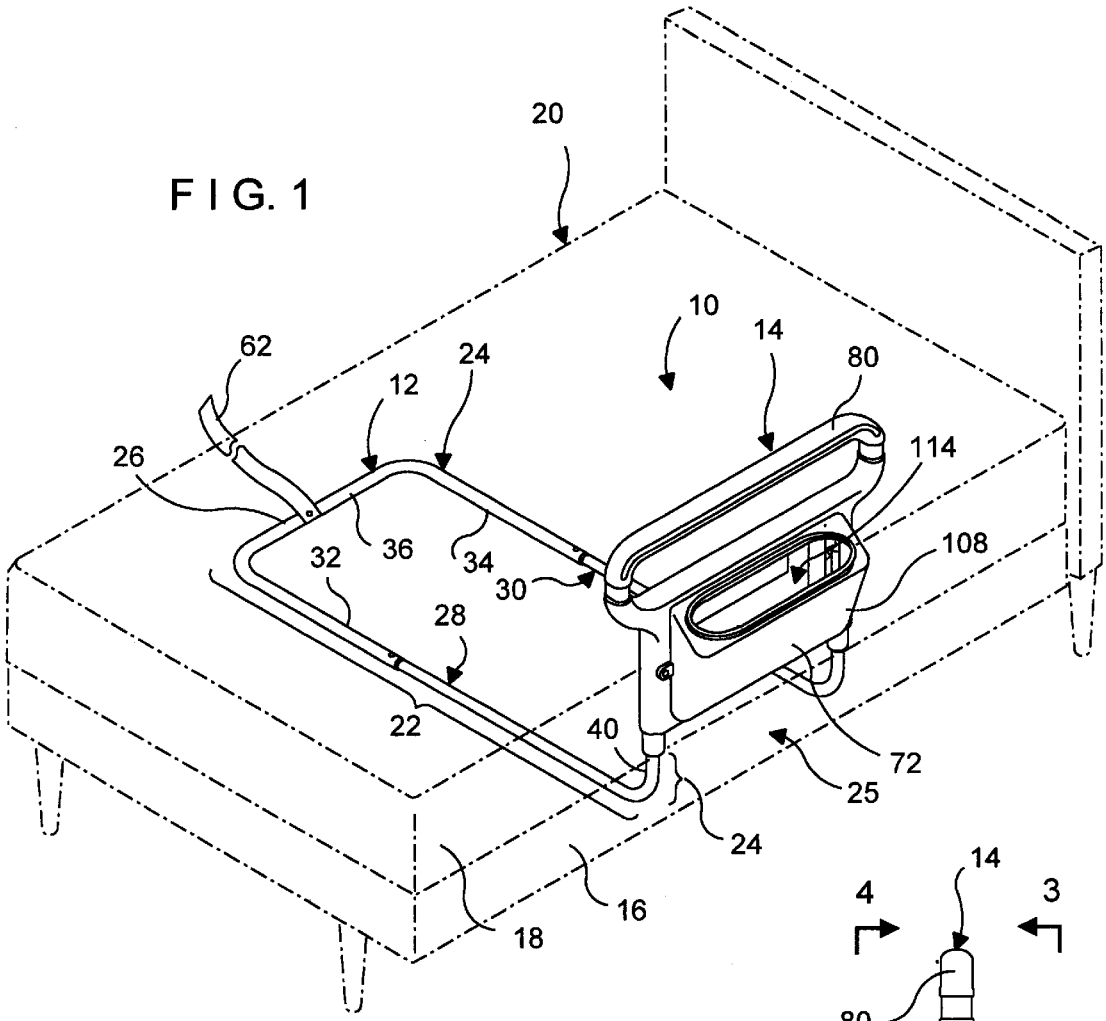
FIG. 1 is an orthographic view of an adjustable support apparatus according to the invention for mounting to a bed.
Figure 2:
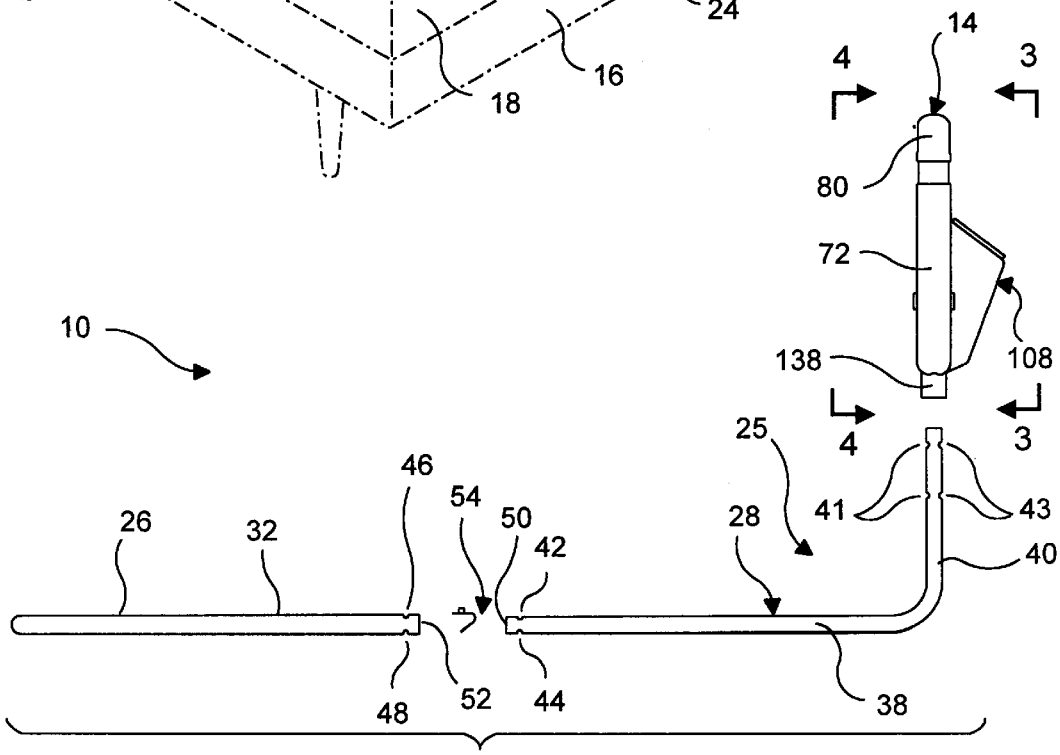
FIG. 2 is an exploded side elevational view of the adjustable support apparatus of FIG. 1.

Referring now to the drawings, and to FIGS. 1 and 2 in particular, an adjustable support apparatus 10 according to the present invention includes a frame assembly 12 and an upright support member 14 connected to the frame assembly. A generally horizontally extending portion 22 of the frame assembly 12 is adapted to fit between a box spring 16 and a mattress 18 of a bed 20 (shown in phantom line), while a generally vertically extending portion 24 of the frame assembly 12 is connected to the upright support member 14 and extends generally vertically from the horizontal portion 22.

The frame assembly 12 includes an extension member 26 that is generally U-shaped in configuration and two angle brackets 28, 30 that are generally L-shaped in configuration. The U-shaped extension member 26 has a pair of spaced tubular legs 32, 34 and a cross member 36 extending between the tubular legs. Preferably, the legs 32, 34 and cross member 36 are formed by bending a piece of tubing into the generally U-shaped configuration. The angle brackets 28 and 30 include a generally horizontally extending leg 38 and a generally vertically extending leg 40. Preferably, the legs 38 and 40 of each angle bracket are formed by bending a piece of tubing into the generally L-shaped configuration. The leg 40 is telescopically received in the upright support member 14. A mounting arrangement in one embodiment of the invention includes pairs of aligned apertures 41 and 43 for adjustably mounting the angle bracket to the support member, the details of which will be described in further detail below with respect to FIGS. 6 and 7. The upright support member 14 and angle brackets 28 comprise a support unit 25 that may be used in conjunction with other support units, as described in further detail below.

Figure 5:
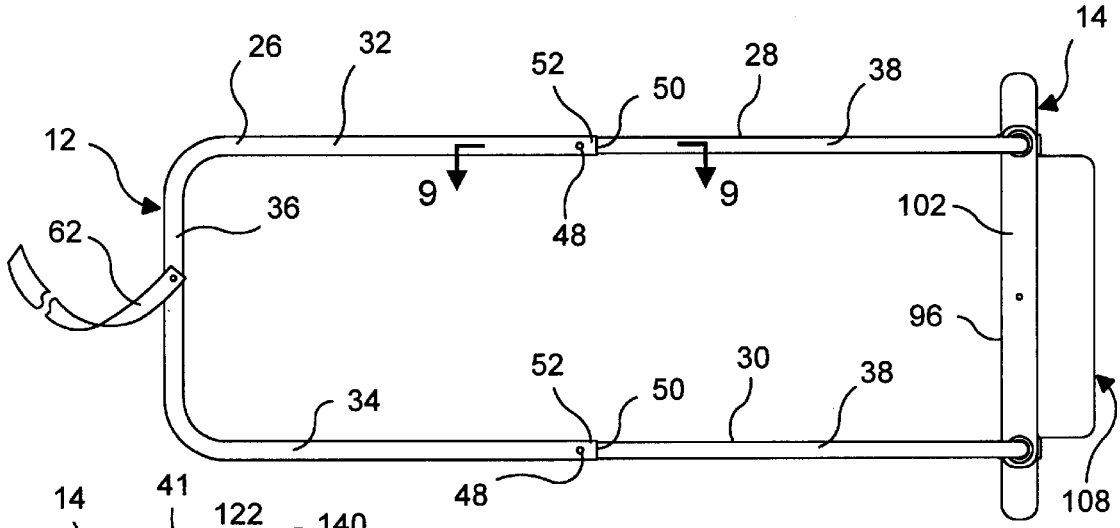
FIG. 5 is a bottom plan view of the adjustable support apparatus.
Figure 9:
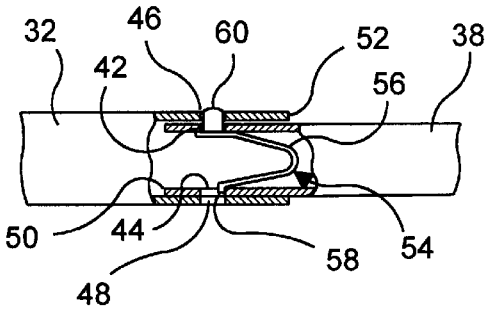
FIG. 9 is a cross sectional view of a locking portion of a mounting arrangement of the base frame assembly taken along line 9—9 of FIG. 5.

With reference now to FIGS. 2, 5 and 9, the leg 38 of each angle bracket is preferably telescopically received in one of the legs 32, 34 of the extension member 26. In the mounting arrangement, a pair of aligned apertures 42, 44 is formed in the leg 38 adjacent the outer free end 50 thereof. Likewise, a pair of aligned apertures 46, 48 is formed in the legs 32, 34 adjacent their respective outer free ends 52. A spring clip 54 is installed in each leg 38 and includes a generally V-shaped flat spring 56 with a lip 58 formed at one end thereof and a boss 60 mounted at the other end thereof. The lip 58 is received in the aperture 44 of the leg 38 while the boss 60 extends through the aperture 42 so as to protrude radially outwardly from the leg 38 (See FIG. 9).

During assembly of the angle brackets 28, 30 to the U-shaped extension member 26, the boss is pressed inwardly against bias force from the flat spring 56 while the leg 38 is telescopically received in one of the legs 32 or 34. The legs are slid together until the aperture 46 is in alignment with the aperture 42, whereupon the boss 60 will spring into the aperture 46 to thereby lock the extension member 26 to the angle bracket. In order to disassemble the extension member 26 from the angle bracket, the boss 60 is pressed inwardly until clear of the aperture 46, then the legs are slid apart. Although a single boss 60 is shown, it is to be understood that the lip 58 may be replaced with an additional boss that would extend through the apertures 44 and 48 when aligned. In this alternative embodiment, both of the bosses would be pressed inward during assembly and disassembly of the legs.

The above-described configuration provides for quick assembly and disassembly of the adjustable support apparatus 10. Although a single aperture pair 46, 48 is shown formed in the legs 32 and 34, a plurality of aperture pairs may be formed along the length of the legs 32 and 34 for adjusting the length of the horizontal portion 22 with respect to the upright support member 14. This feature allows the support apparatus 10 to be adjusted for beds of different widths. Although, a specific mounting arrangement has been discussed hereinabove, it should be understood that any conventional structure providing required adjustment of a position of the angle brackets relative to the extension member and the upright support member is within the scope of the invention.

Referring again to FIG. 1, a flexible strap 62 may be attached to the cross member 36 for positioning the adjustable support apparatus 10 at a proper position with respect to the bed and for securing the adjustable support apparatus to the bed. The strap 62 may include securing means such as hook and loop fasteners, snaps, buckles, and the like. The strap may be wrapped around a carrying handle (not shown) of the mattress 18 or around a bed frame (not shown) and then secured to itself. The strap 62 can alternatively be directly attached to the bed structure, such as the mattress 18, box spring 16, or bed frame through cooperating hook and loop fasteners or other well-known fastening means on the strap and/or bed structure. With the support apparatus 10 secured to the bed by the strap 62, an additional measure of safety is provided to persons using the support apparatus 10, especially while pulling or pushing the upright support member 14 in a direction that would otherwise tend to remove the apparatus from the bed.

Figure 3:
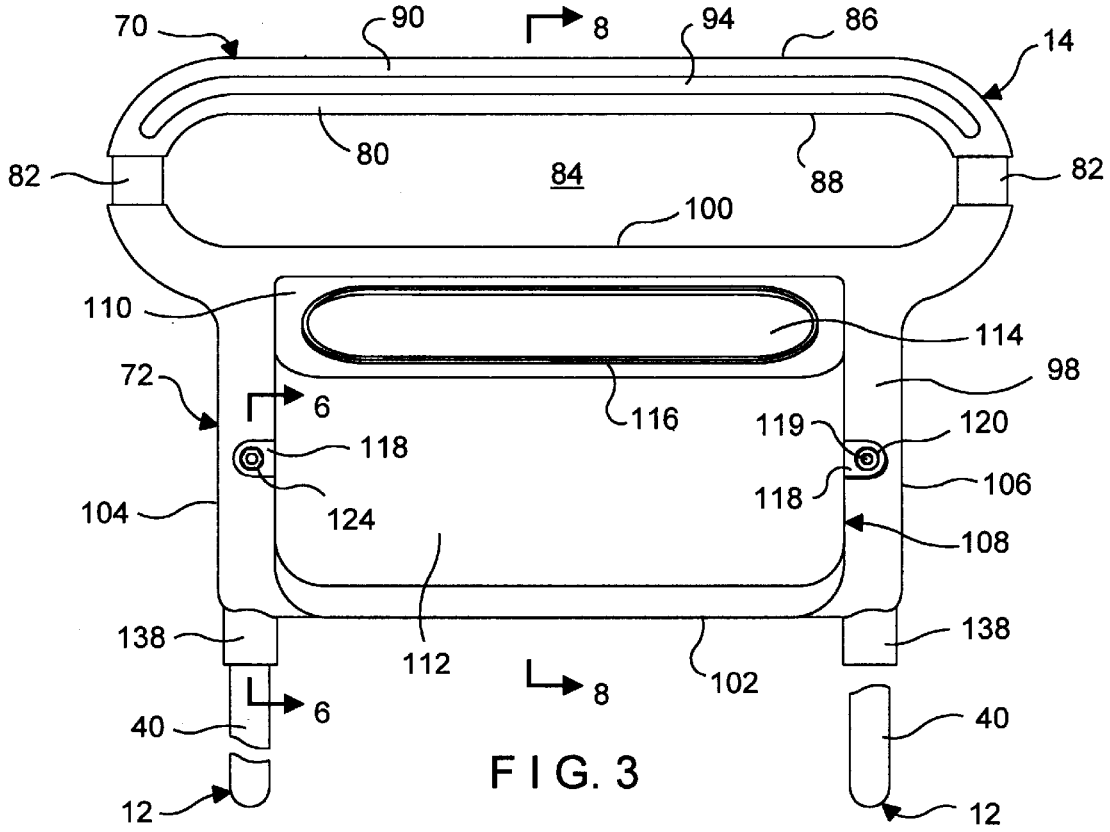
FIG. 3 is a front elevational view of the adjustable support apparatus taken along line 3—3 of FIG. 2.
Figure 4:
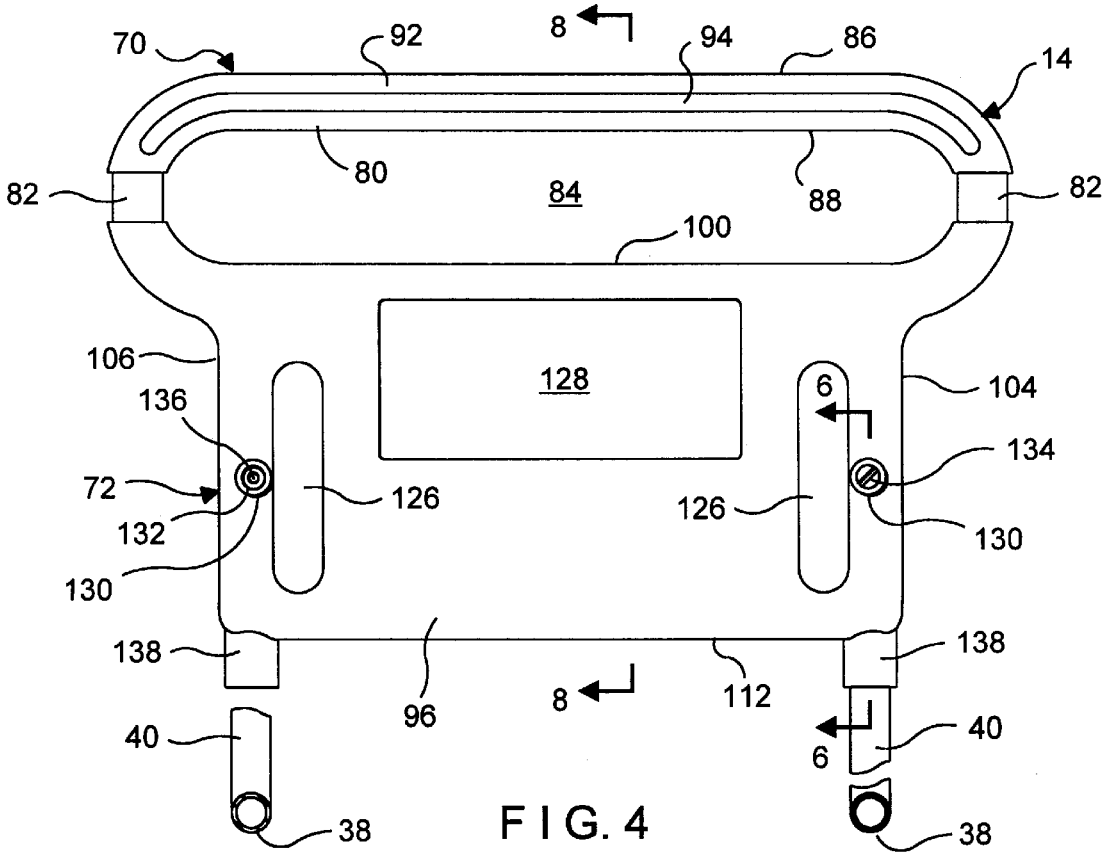
FIG. 4 is a rear elevational view of the adjustable support apparatus taken along line 4—4 of FIG. 2 with a portion of the apparatus shown in cross section.
Figure 8:
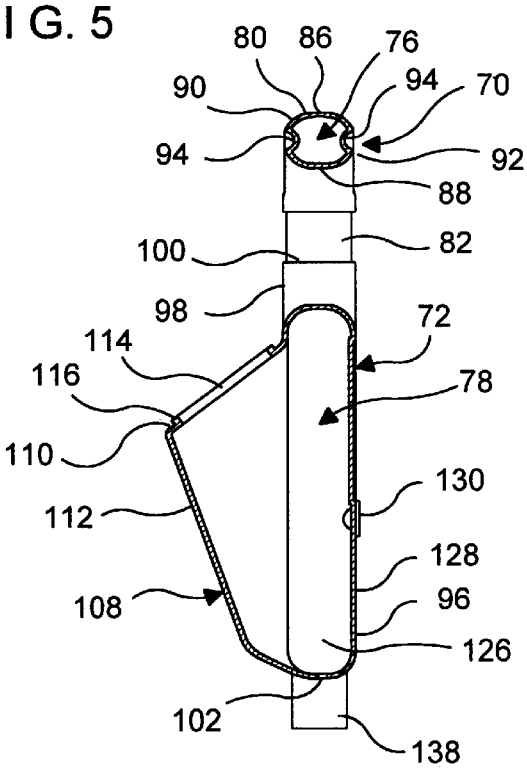
FIG. 8 is a cross sectional view taken along line 8—8 of FIGS. 3 and 4.

Turning now to FIGS. 3, 4 and 8, the upright support member 14 includes an inverted U-shaped handle 70 extending upwardly from a compartment 72. Preferably, the handle and compartment are constructed of a plastic material and are integrally formed as a unitary structure during blow molding or other molding operation to form a substantially hollow interior 78 of the compartment 72. The handle 70 can be also formed with a hollow interior 76 which is some embodiments of the invention is capable of communicating with the compartment 72. The material of at least the handle 70 is preferably electrically insulating to thereby prevent the transfer of static electricity between a person and the upright support member.

The handle 70 includes an elongate bar 80 that is adapted to be grasped by the hand of a user. In one embodiment of the invention, the bar 80 is separated from the compartment 72 by a pair of substantially hollow columns 82 formed at opposite ends of the bar 80. The columns 82 form a space 84 between the bar and compartment. The bar 80 includes relatively smooth upper and lower walls 86 and 88, respectively, with a front wall 90 and rear wall 92 extending between the upper and lower walls to thereby form the hollow interior 76. An elongate groove 94 is formed in the front and rear walls to give extra strength and rigidity, as well as an aesthetically pleasing appearance to the handle 70.

The compartment 72 includes a rear wall section 96 connected to a front wall section 98 through an upper wall section 100, lower wall section 102, and side wall sections 104, 106 to thereby form the hollow interior 78. A pocket 108 extends outwardly from the front wall section 98 and is generally triangular in cross section, as shown most clearly in FIG. 8. The pocket 108 includes an upper wall 110 that preferably extends at an acute angle with respect to the upper wall section 100 and a front wall 112 that preferably extends at an acute angle with respect to the rear wall section 98. An elongate opening 114 is formed in the upper wall 110 of the pocket 108 and a lip 116 is formed around the periphery of the opening. The lip 116 serves to increase the strength and rigidity of the material surrounding the opening 114. The pocket 108 may be used to conveniently store items at the bedside, such as medication, books, tissue, remote controls, and so on. A cap (not shown) may be provided to cover the opening 114.

Raised tabs 118 can be formed in the front wall section 98 of the compartment. Each tab 118 includes a countersink 119 for receiving a locknut 124 and an aperture 120 for receiving a shaft 125 of a fastener 122.

A pair of elongate, semi-cylindrical depressions 126 are formed in the rear wall section 96. The depressions are preferably spaced from the side wall section 104, 106, and extend substantially parallel thereto. Each depression 126 extends into the pocket 108 and serves to guide the leg 40 of each angle bracket 28 during insertion of the leg into the compartment 72 and upon insertion restricts side motions of the respective leg within the compartment. The depressions 126 also stiffen and strengthen the compartment in the vicinity of the leg 40. A rectangular depression 128 is formed in the rear wall 96 and serves to strengthen the rear wall and provide a more aesthetically pleasing appearance. If desired, an instruction label or advertisement can be positioned within the depression. A raised boss 130 is formed in the rear wall 96 between each depressions 126 and the side walls 104, 106 of the compartment. Each boss 130 includes a countersink 132 for receiving a fastener head 134 of the fastener 122 and an aperture 136 for receiving the fastener shaft.

A tubular projection 138 is formed integrally with the lower wall 102 adjacent each side wall 104, 106. Each tubular projection 138 extends downwardly from the lower wall 102 and is adapted to slidably receive the leg 40 of one of the angle brackets 28.

Figure 6:
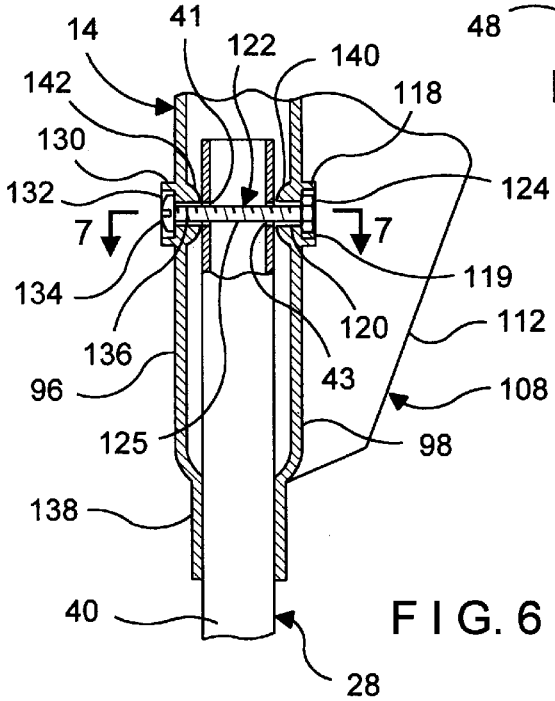
FIG. 6 is a cross sectional view taken along line 6—6 of FIGS. 3 and 4 and illustrating a preferred manner in which a frame assembly is connected to an upright support portion of the adjustable support apparatus.
Figure 7:
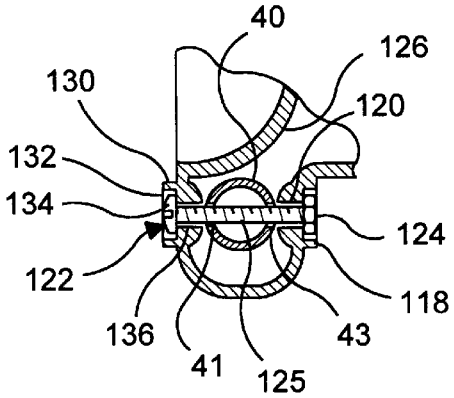
FIG. 7 is a cross sectional view taken along line 7—7 of FIG. 6.

With particular reference to FIGS. 6 and 7, the angle brackets 28 are connected to the upright support member 14 by inserting the leg 40 of each angle bracket into one of the tubular projections 138 until one of the pairs of apertures 41, 43 in the leg is in alignment with the apertures 120 and 136. The shaft 125 of a fastener 122 is then inserted through the apertures 136, 41, 43, and 120 and a locknut 124 is installed on the fastener. Although two pairs of aligned apertures 41, 43 are shown in FIG. 2, it is to be understood that more or less pairs of apertures may be provided, depending on the desired height of the upper handle portion 70 with respect to the horizontal portion 22, and thus the bottom of the mattress 18, especially since the height of the mattress 18 may greatly vary. As previously noted, the elongate semi-cylindrical depressions 126 serve to guide the legs 40 during installation into the upright member 14. In addition, the tab 118 and boss 130 each have thickened inner portions 140 and 142, respectively, to guide and support the legs 40 and give additional structural support to the walls 98 and 96. Although FIGS. 6 and 7 illustrate the specific connecting arrangement between the leg of the angle bucket and the support member, any conventional means of securing these elements together is within the scope of the invention.

Figure 12:
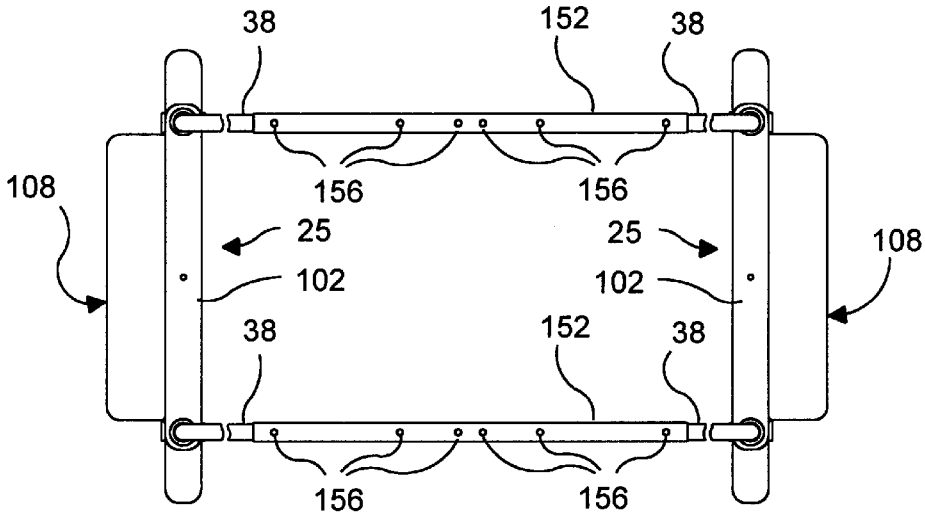
FIG. 12 is a bottom plan view of the adjustable support apparatus of FIG. 10.

With reference now to FIGS. 10 to 12, an adjustable support apparatus 150 according to a second embodiment of the invention is illustrated, wherein like parts in the previous embodiment are represented by like numerals. The adjustable support apparatus 150 is similar in construction to the apparatus 10, with the exception that the U-shaped extension 26 is replaced with an additional support unit 25 (comprising an upright support member 14 and angle brackets 28) and a pair of connecting sleeves 152. Each connecting sleeve 152 telescopically receives opposing legs 38 of opposing angle brackets 28, 30 to thereby connect the support units 25 together in one unitary structure. Pairs of aligned apertures 154, 156 are formed in each connecting sleeve 152 along the length thereof. A spring clip 54 is installed in each leg 38, as in the previous embodiment.

During assembly of each angle bracket 28, 30 to the connecting sleeves 152, the boss 60 of the spring clip 54 is pressed inwardly against bias force while the leg 38 is telescopically received in one end of one of the sleeves 152. The leg 38 and sleeve 152 are slid together until one of the apertures 154 of the sleeve is in alignment with the aperture 42 of the leg 38, whereupon the boss 60 will spring into the aperture 154 to thereby lock the sleeve to the angle bracket. The above-described configuration provides for quickly assembly, adjustment, and disassembly of the support apparatus 150. The multiple apertures 154 and 156 formed in the sleeves 152 allow the support apparatus 150 to be adjusted for beds or mattresses of different widths. Obviously, any other conventional means of adjustment and securing a position of the legs 38 relative to the sleeves 152 is within the scope of the invention.

The opposing configuration of the support units 25, including the upright support members 14, enables a person to rise from the bed or transfer between the bed and a wheel chair or other apparatus from either side of the bed. The support units 25 also serve as side rails to prevent a person from falling out of bed when properly installed. Although not shown, a strap similar to strap 62 in the previous embodiment may be connected to one or both support units for manipulating and securing the support apparatus 150 to the bed or bed frame.

Figure 13:
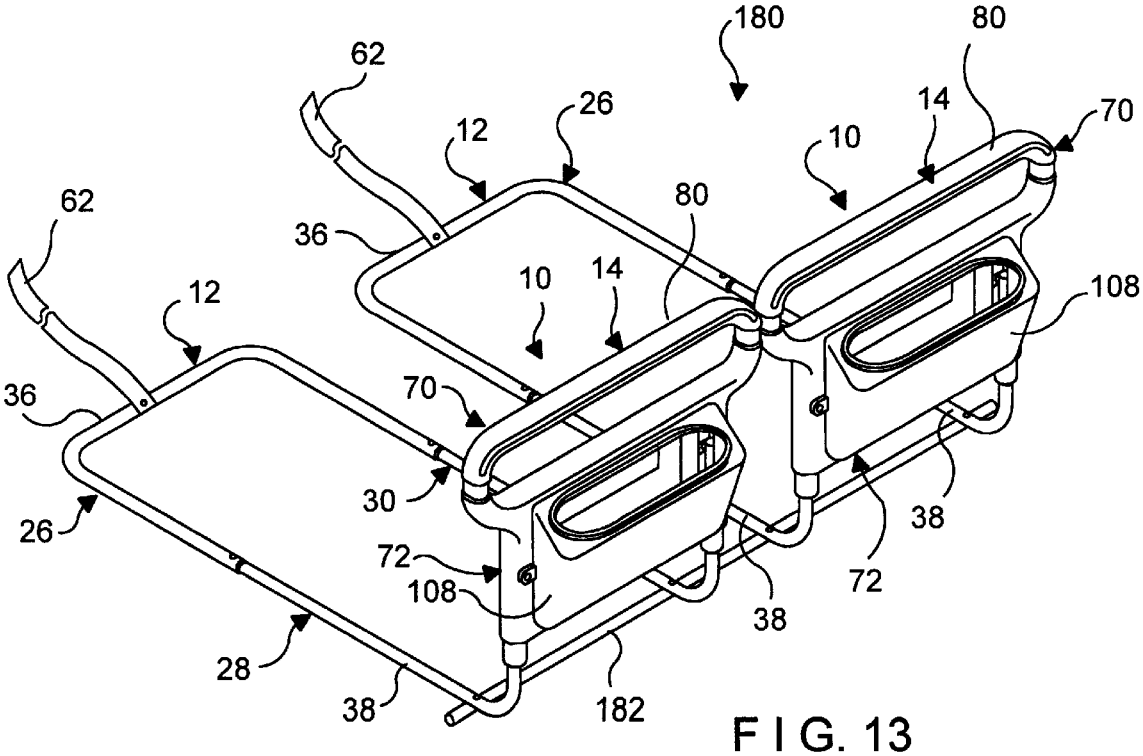
FIG. 13 is an orthographic view of an adjustable support apparatus according to a third embodiment of the invention.

Turning now to FIG. 13, an adjustable support apparatus 180 according to a third embodiment of the invention is illustrated, wherein like parts in the previous embodiments are represented by like numerals. The adjustable support apparatus 180 comprises two adjustable support structures 10 arranged in tandem and connected to each other through an elongate connecting rod 182. The rod 182 is preferably constructed from tubular material, but may alternatively be constructed of a solid bar. The connecting rod 182 extends transverse to the legs 38 and is connected thereto through suitable fasteners that extend through the legs 38 and the rod 182. An additional rod (not shown) may also extend between, and be connected to the cross members 36. The tandem arrangement of the two adjustable support apparatus provide a longer grasping area with two handles 70 available to the user. In addition, the tandem arrangement further helps to prevent greater length of the body of the user from falling out of bed.

If desired, the U-shaped extension 26 of each support apparatus 10 can be removed and replaced with a support unit 25 as in the embodiment of FIGS. 10 and 11, to thereby provide dual tandem support units at either side of the bed. The additional support apparatuses may also be connected together through an additional connecting rod 182.

Figure 14:
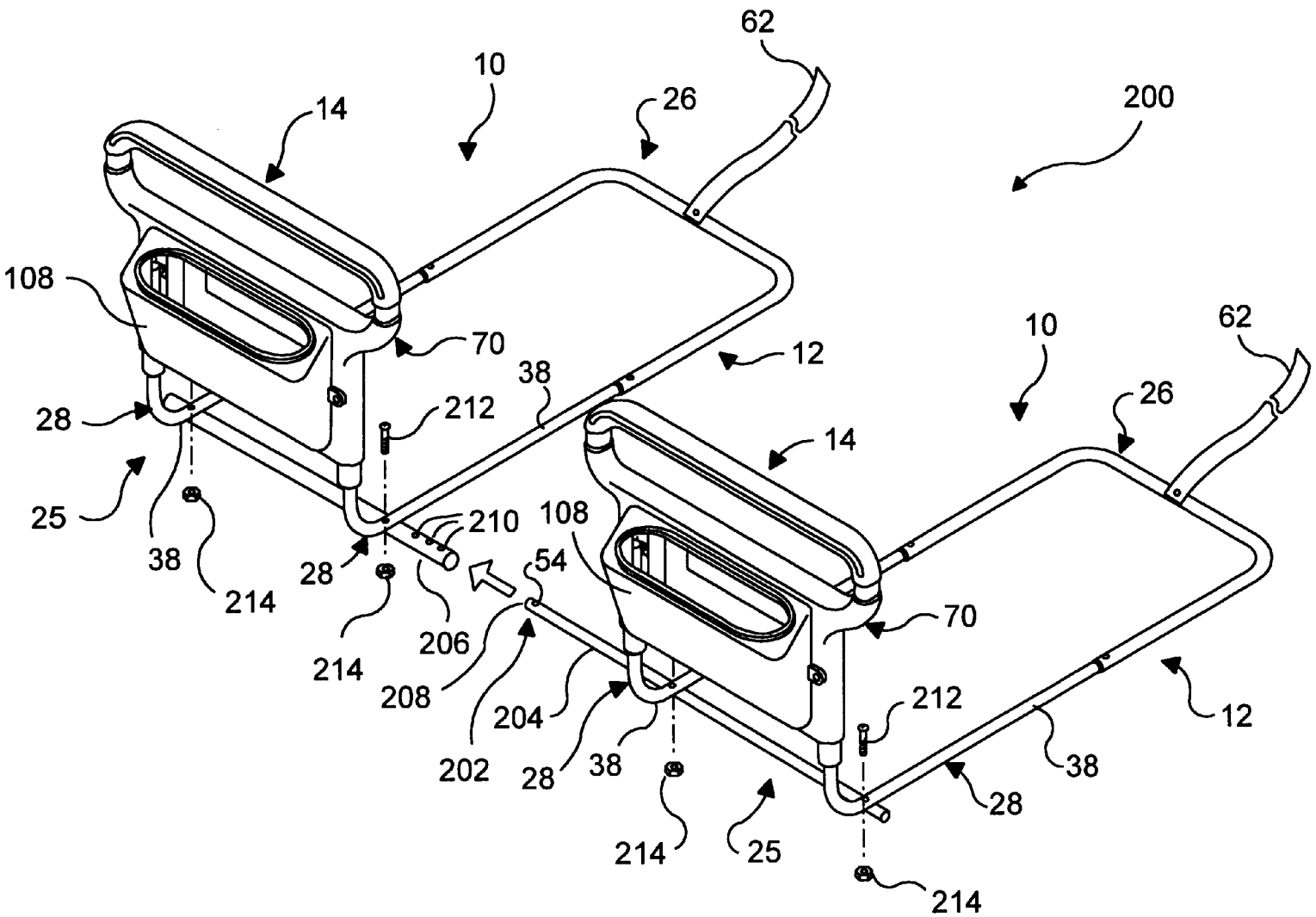
FIG. 14 is an orthographic view of an adjustable support apparatus according to a fourth embodiment of the invention.

With reference now to FIG. 14, an adjustable support apparatus 200 according to a fourth embodiment of the invention is illustrated, wherein like parts in the previous embodiments are represented by like numerals. The adjustable support apparatus 200 is similar in construction to the adjustable support apparatus 180 of FIG. 13, with the exception that the rod 182 is replaced with a telescopic rod assembly 202. The telescopic rod assembly 202 includes a first tubular portion 204 that is telescopically received in a second tubular portion 206. A spring clip 54 is positioned proximal an end 208 of the first tubular portion 204, preferably in the same manner as previously described with respect to FIG. 9. When the first tubular portion 204 is received in the second tubular portion 206, the spring clip 54 can be selectively positioned in one of a plurality of apertures 210 extending along the second tubular portion. The tubular portions 204 and 206 preferably extend transverse to the legs 38 of the angle brackets 28 and are secured thereto through suitable fasteners 212 and locknuts 214. In this manner, the distance between the tandem adjustable support apparatus 10 can be adjusted to thereby accommodate the size and strength of a user, especially when rising from the bed or transferring between the bed and a wheel chair or other apparatus.

As in the third embodiment (see FIGS. 10 and 11), the U-shaped extension 26 of each support apparatus 10 can be removed and replaced with a support unit 25 to thereby provide dual tandem support units at either side of the bed. The additional support units would also be connected together through an additional telescopic rod assembly 202.

Figure 15:
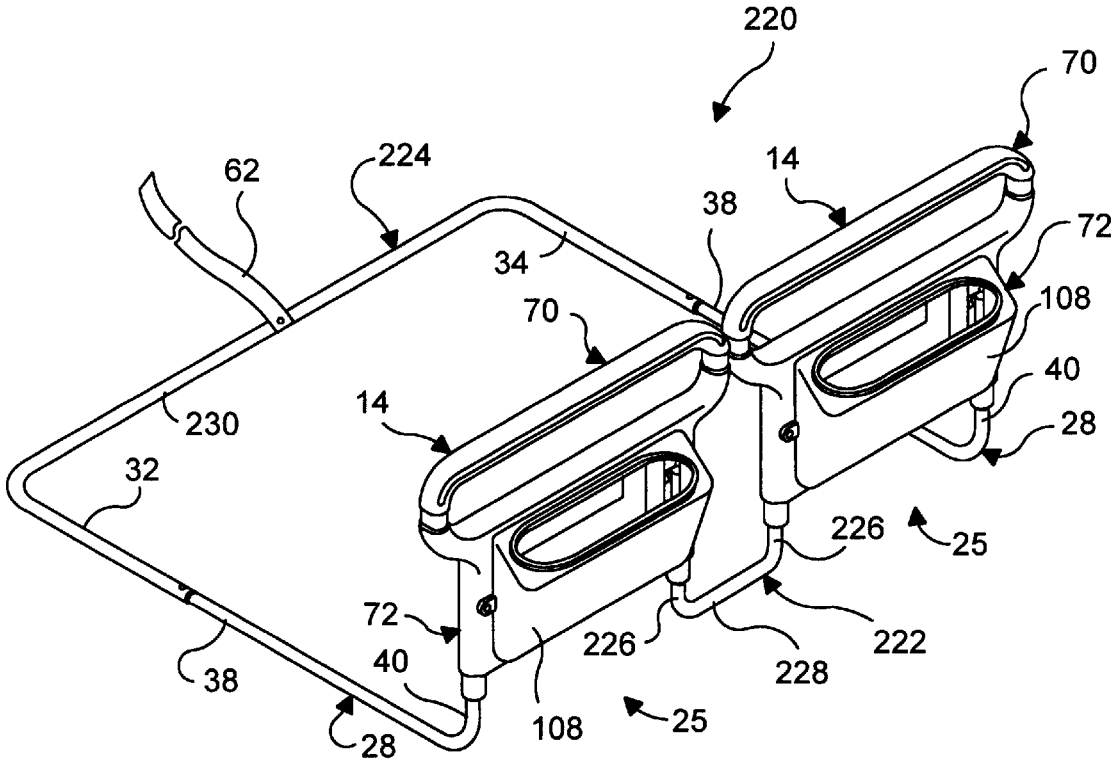
FIG. 15 is an orthographic view of an adjustable support apparatus according to a fifth embodiment of the invention.

With reference now to FIG. 15, a an adjustable support apparatus 220 according to a fifth embodiment of the invention is illustrated, wherein like parts in the previous embodiments are represented by like numerals. The adjustable support apparatus 220 is similar in construction to the adjustable support apparatus 180 illustrated in FIG. 13, with the exception that adjacent inner angle brackets 38 of each support unit 25 are replaced with a single U-shaped bracket 222 and the separate U-shaped extension members 26 are replaced with a single U-shaped extension member 224. The bracket 222 includes a pair of upright legs 226 extending from opposite ends of a cross member 228. Preferably, the legs and cross member are formed from a single piece of tubular material. The legs 226 telescopically extend into the compartment 72 in a manner similar to the legs 40, as shown in FIGS. 6 and 7. The U-shaped extension member 224 comprises legs 32 and 34 connected to opposite ends of an elongate cross member 230. The distance between the legs 32 and 34 as set by the cross member 230 is such that each leg telescopically receives one of the outer angle brackets 28 of the upright support units 25 in a manner similar to the FIG. 2 embodiment. Preferably, the legs 226 and 40 are of the same length so that the U-shaped extension member 224 and the cross member 228 lie in the same plane.

Figure 16:
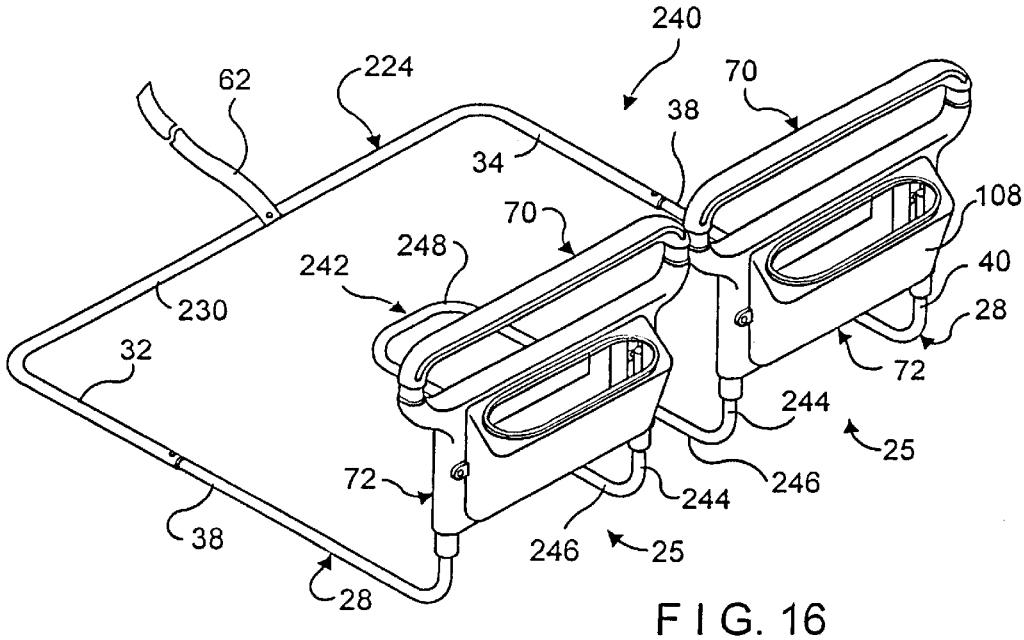
FIG. 16 is an orthographic view of an adjustable support apparatus according to a sixth embodiment of the invention.

With reference now to FIG. 16, a an adjustable support apparatus 240 according to a sixth embodiment of the invention is illustrated, wherein like parts in the previous embodiments are represented by like numerals. The adjustable support apparatus 240 is similar in construction to the adjustable support apparatus 220 illustrated in FIG. 15, with the exception that the U-shaped bracket 222 is replaced with a U-shaped angle bracket 242. The bracket 242 includes a pair of upright legs 244, each connected to a pair of generally horizontally extending legs 246. The legs 246 are in turn connected to opposite ends of a cross member 248. Preferably, the legs 244, 246 and cross member 248 are formed from a single piece of tubular material. The legs 244 telescopically extend into the compartment 72 in a manner similar to the legs 40, as shown in FIGS. 6 and 7. When installed on a bed, the U-shaped member 224 and the legs 246 and cross member 248 of the U-shaped angle bracket 242 are received between the box spring 16 and mattress 18 in a manner similar to that illustrated in FIG. 1.

Figure 17:
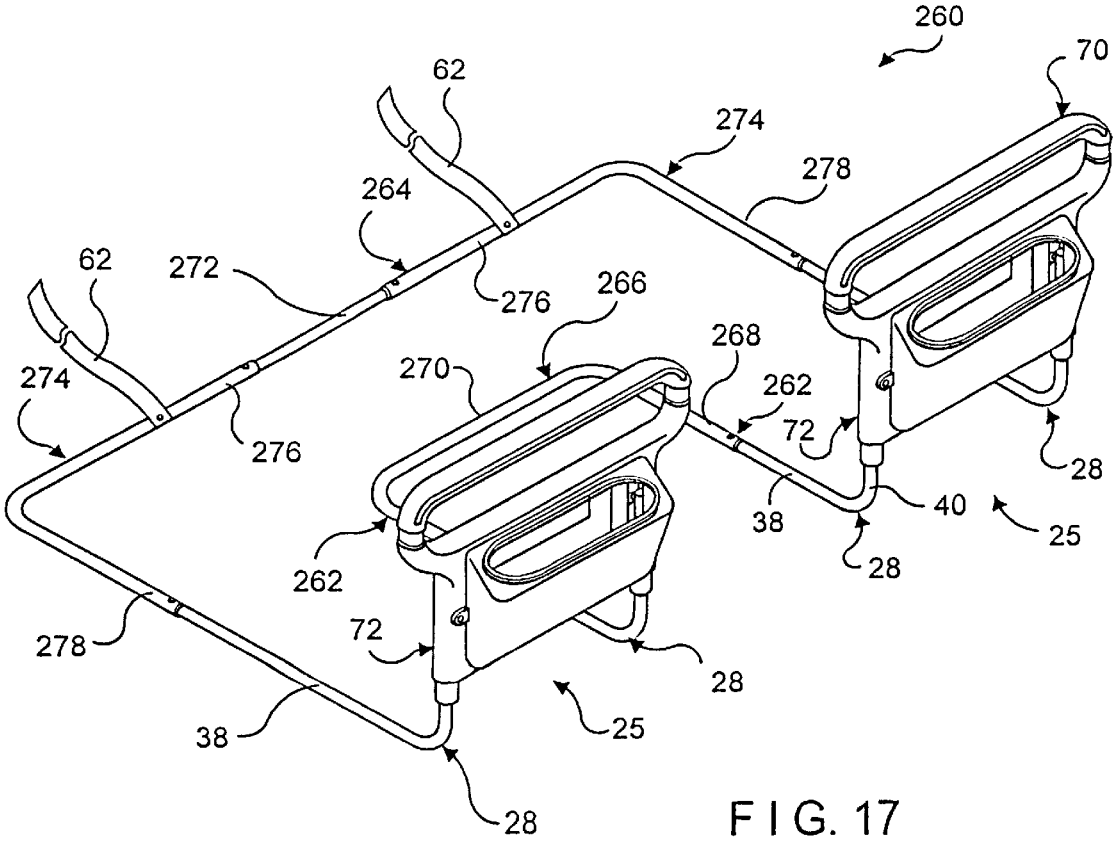
FIG. 17 is an orthographic view of an adjustable support apparatus according to a seventh embodiment of the invention.

Referring now to FIG. 17, an adjustable support apparatus 260 according to a seventh embodiment of the invention is illustrated, wherein like parts in the previous embodiments are represented by like numerals. The adjustable support apparatus 260 is similar in construction to the adjustable support apparatus 240 illustrated in FIG. 16, with the exception that the distance between the upright support units 25 is adjustable and often greater and the legs 246 of the U-shaped angle bracket 242 and cross member 230 of the U-shaped extension member 224 are replaced with telescopic legs 262 and a telescopic cross member 264. Each telescopic leg includes an inner leg 38 of an inner angle bracket 28 and a leg 268 of a U-shaped extension member 266. Preferably, the inner legs 38 are telescopically received in the legs 268 in a manner shown in FIG. 9. The legs 268 of the extension member 266 are connected to opposite ends of an elongate cross member 270. Preferably, the legs 268 and cross member are constructed of a single piece of tubing. The cross member 264 includes a rod or tube 272 that is telescopically received in a first leg 276 of L-shaped tubes 274. A second leg 278 of each L-shaped tube 274 preferably telescopically receives the leg 38 of an outer angle bracket 28.

Figure 18:
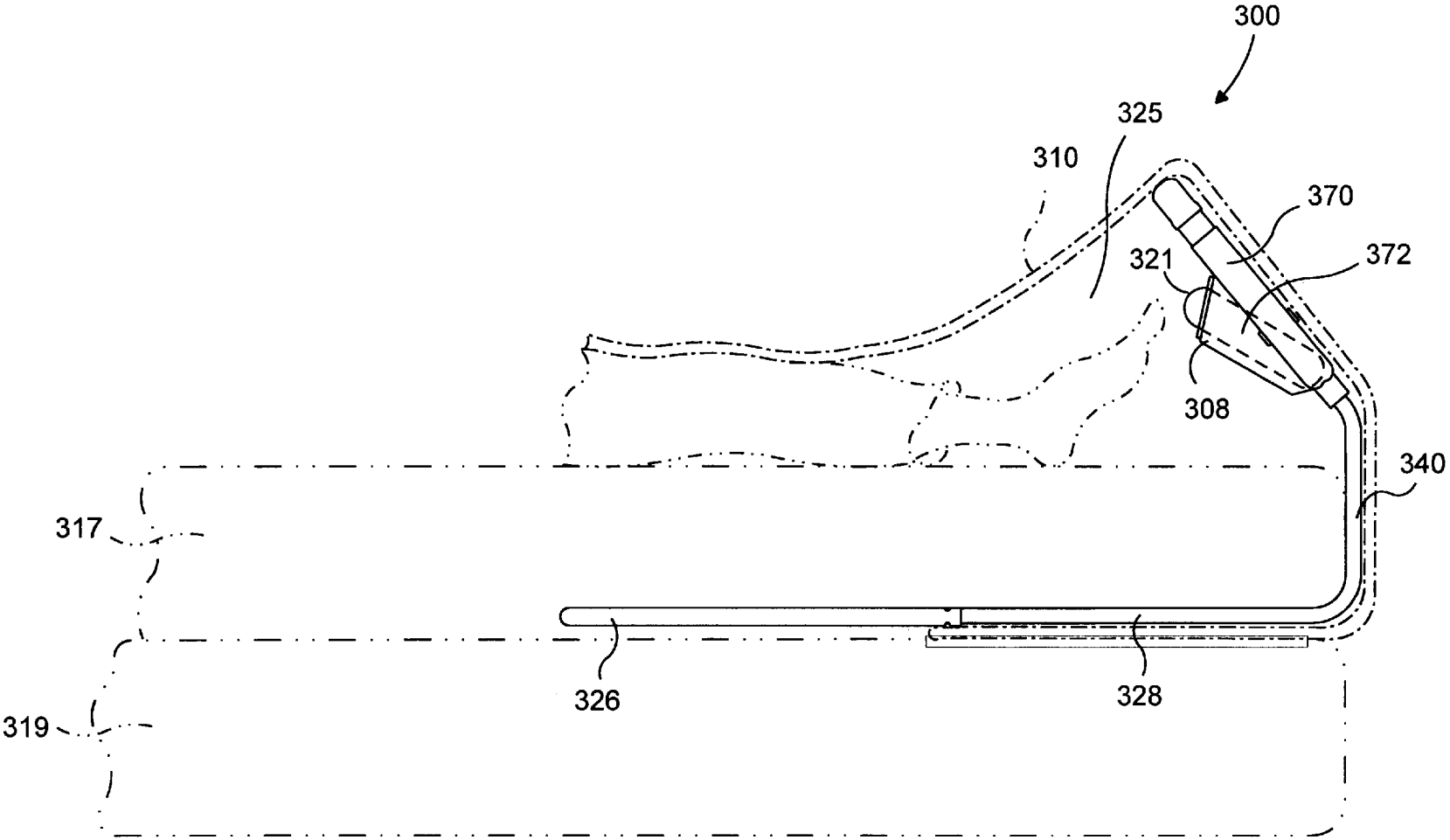
FIG. 18 is a side elevational view of the adjustable support apparatus according to an eighth embodiment of the invention.
Figure 19:
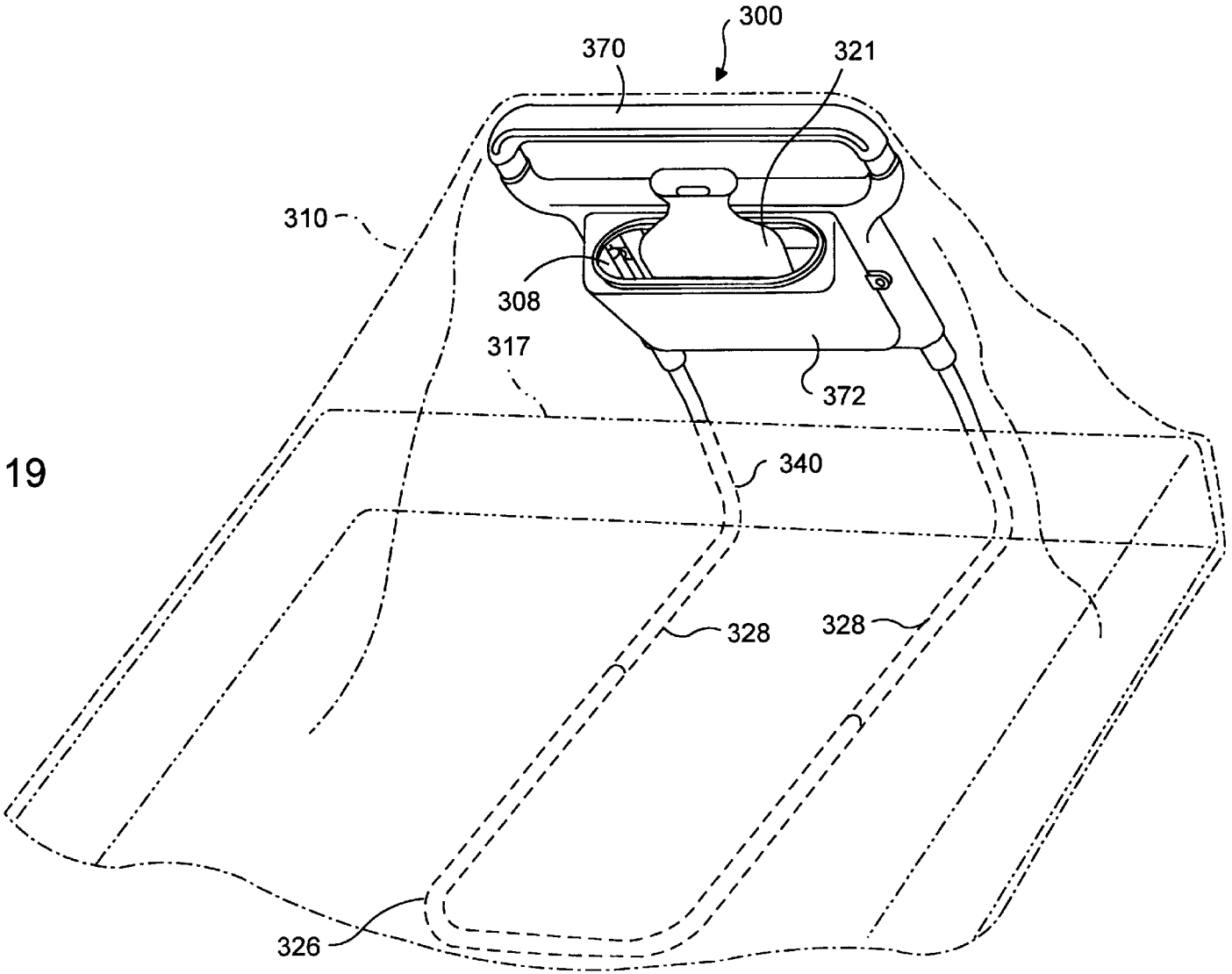
FIG. 19 is an orthographic view of the adjustable support apparatus of FIG. 18.

Referring now to FIGS. 18 and 19, an adjustable support apparatus 300 according to an eighth embodiment of the invention is illustrated. The adjustable support apparatus 300 is similar in construction to the adjustable support apparatus 10 illustrated in FIGS. 1 and 2, with the exception that the compartment 372 with the pocket 308 face the user lying on a mattress 317 positioned on the top of a boxspring 319. The handle 370 and the compartment 372 are positioned at an angle to the leg 340, 328 adjustably received in the U-shaped extension member 326. Thus, the compartment 372 and the pocket 308 are positioned closer to the feet of a user. In the apparatus of FIGS. 18 and 19 the leg 340 is typically higher than the corresponding part of the apparatus of FIG. 2, so as to elevate the handle 370 and the compartment 372 substantially above the top of the mattress 317. In use, a blanket 310 is positioned over the feet of the user and over the handle 370 and the compartment 372. A free end of blanket is preferably positioned between the mattress 317 and the boxspring 319. A container 321 with hot fluid is situated within the pocket 308 in the vicinity of the user's feet. Thus, the blanket 310 is lifted to avoid the direct contact with the feet of the user. Furthermore, this arrangement forms a semi-closed space 325 which traps heat radiated by the hot fluid of the container 321, warming feet of a user for a longer period of time.

It is to be understood that the terms horizontal, vertical, front, rear, upper, lower, upright, inner, and outer, and their respective derivatives as used herein refer to relative, rather than absolute positions.

While the invention has been taught with specific reference to the above-described embodiments, those skilled in the art will recognize that changes can be made in form and detail without departing from the spirit and the scope of the invention. For example, although the angle brackets and the extension members are shown as circular in cross section, they may be square, oval, triangular, or other cross sectional shape. Moreover, although the upright support members 14 and associated frame assemblies have been shown and described for particular use with beds, it is to be understood that the invention is not limited thereto, since the support members may also be adapted for use in walkers, wheelchairs, bathtub supports, chair supports, and the like. In spite of the fact that specific ways of connection between the support members 14 and frame assemblies, as well as the specific means of adjustment and securing parts of the frame relative to each other have been disclosed hereinabove, it is obvious that any conventional means of adjustment and securing such elements are within the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A support apparatus for facilitating movement of a person from one position to another, the apparatus comprising:

a compartment portion having a front wall connected to a rear wall by opposing side walls and upper and lower walls to thereby form a hollow interior, an opening being formed in the compartment portion for permitting access to the hollow interior;

a handle portion connected to the compartment portion, the handle portion including an elongate bar spaced from the compartment portion and sized to be grasped by the hand of a person; and a frame assembly having a pair of spaced frame members connected to the compartment portion and extending downwardly therefrom for mounting the support apparatus to a structure; each said frame member is L-shaped and includes a first leg telescopically received in the compartment portion and a second leg extending substantially perpendicular from the first leg.

2. A support apparatus according to claim 1, and further comprising a pocket formed in the compartment portion, the pocket extending outwardly from one of the compartment walls, and wherein the opening is formed in the pocket for permitting access to the hollow interior through the pocket.

3. A support apparatus according to claim 2, wherein the pocket includes a front wall that extends outwardly and upwardly from a location at least proximal to the bottom wall of the compartment.

4. A support apparatus according to claim 3, wherein the pocket includes an upper wall that extends outwardly and downwardly toward the front wall of the pocket from the front wall of the compartment, and further wherein the opening is formed in the upper wall of the pocket.

5. A support apparatus according to claim 4, wherein the handle portion includes a hollow interior that is in communication with the hollow interior of the compartment portion.

6. A support apparatus according to claim 5, wherein the compartment portion and handle portion are integrally formed as a unitary structure.

7. A support apparatus according to claim 1, wherein the compartment portion and handle portion are integrally formed as a unitary structure.

8. A support apparatus according to claim 1, wherein the frame assembly further comprises a U-shaped extension having a pair of spaced extension legs extending from opposite ends of a cross member, each of the extension legs being in telescopic engagement with one of the second legs to thereby adjust the distance between the cross member and the compartment portion.

9. A support apparatus according to claim 8, and further comprising a strap connected to the U-shaped extension for securing the support apparatus to a structure.

10. An adjustable support apparatus for facilitating movement of a person from one position to another, the apparatus comprising:

a compartment portion having a front wall connected to a rear wall by opposing side walls and upper and lower walls to thereby form a hollow interior;

a handle portion connected to the compartment portion, the handle portion including an elongate bar spaced from the compartment portion and sized to be grasped by the hand of a person; and a frame assembly having a pair of spaced frame members connected to the compartment portion and extending downwardly therefrom for mounting the support apparatus to a structure, each said frame member is L-shaped and includes a first leg telescopically received in the compartment portion and a second leg extending substantially perpendicular from the first leg.

11. An adjustable support apparatus according to claim 10, wherein the first leg of each frame member comprises a plurality of securing positions for lockably adjusting the height of the handle and compartment portions with respect to the second legs.

12. An adjustable support apparatus according to claim 11, wherein the frame assembly further comprises a U-shaped extension having a pair of spaced extension legs extending from opposite ends of a cross member, each of the extension legs being in telescopic engagement with one of the second legs and having a plurality of securing positions for lockably adjusting the distance between the cross member and the handle and compartment portions.

13. An adjustable support apparatus according to claim 12, and further comprising a strap connected to the U-shaped extension for securing the support apparatus to a structure.

14. An adjustable support apparatus for facilitating movement of a person from one position to another, the apparatus comprising:

at least two upright support units arranged substantially parallel to each other, each unit including a compartment portion having a front wall connected to a rear wall by opposing side walls and an upper and lower wall to thereby form a hollow interior, and a handle portion connected to the compartment portion, the handle portion including an elongate bar spaced from the compartment portion and sized to be grasped by the hand of a person; and a frame assembly including a pair of spaced upright frame members connected to each compartment portion and extending downwardly therefrom, and at least one transverse frame member connected to the pairs of spaced upright frame members, thereby connecting the at least two upright support units together.

15. An adjustable support apparatus according to claim 14, wherein each upright frame member is L-shaped and includes a first leg telescopically received in the compartment portion and a second leg extending substantially perpendicular from the first leg.

16. An adjustable support apparatus according to claim 15, wherein the rear walls and the second legs of the upright support units face each other in opposing relationship, and further wherein the at least one transverse frame member comprises a plurality of transverse frame members, each transverse frame member being in telescopic engagement with a set of opposing second legs.

17. An adjustable support apparatus according to claim 14, wherein the upright support units are arranged in tandem.

18. An adjustable support apparatus according to claim 17, wherein the at least one transverse frame member includes a first tubular segment connected to one of the pairs of upright frame members and a second tubular segment connected to the other of the pairs of upright frame members, the first tubular segment being in telescopic engagement with the second tubular segment to thereby adjust the distance between the upright support units.

19. An adjustable support apparatus according to claim 18, wherein the first segment includes a plurality of securing positions for lockably adjusting the length of the transverse frame member and thus the distance between the upright support units.

20. An adjustable support apparatus according to claim 14, and further comprising a pocket formed in each compartment portion, the pocket extending outwardly from one of the compartment walls, and an opening being formed in the pocket for permitting access to the hollow interior through the pocket.

21. A support apparatus according to claim 20, wherein the pocket includes a front wall that extends outwardly and upwardly from a location at least proximal to the bottom wall of the compartment.

22. A support apparatus according to claim 21, wherein the pocket includes an upper wall that extends outwardly and downwardly toward the front wall of the pocket from the front wall of the compartment, and further wherein the opening is formed in the upper wall of the pocket.

23. A support apparatus according to claim 22, wherein the handle portion includes a hollow interior that is in communication with the hollow interior of the compartment portion.

24. A support apparatus according to claim 23, wherein the compartment portion and handle portion are integrally formed as a unitary structure.

* * * * *